US011230402B2

(12) United States Patent
Stevanov et al.

(10) Patent No.: US 11,230,402 B2
(45) Date of Patent: Jan. 25, 2022

(54) LABEL DISPENSER APPARATUS

(71) Applicant: 2109519 Ontario Ltd., Oldcastle (CA)

(72) Inventors: Aleksandar Stevanov, Windsor (CA); Milena Stevanov, Windsor (CA)

(73) Assignee: 2109519 ONTARIO LTD., Oldcastle (CA)

( * ) Notice: Subject to any disclaimer, the term of this patent is extended or adjusted under 35 U.S.C. 154(b) by 256 days.

(21) Appl. No.: 15/278,539

(22) Filed: Sep. 28, 2016

(65) Prior Publication Data

US 2017/0015457 A1 Jan. 19, 2017

Related U.S. Application Data

(63) Continuation-in-part of application No. 14/680,896, filed on Apr. 7, 2015, now abandoned.

(60) Provisional application No. 62/233,457, filed on Sep. 28, 2015, provisional application No. 61/976,402, filed on Apr. 7, 2014.

(51) Int. Cl.

| | |
|---|---|
| ***B65C 9/18*** | (2006.01) |
| ***B65C 9/26*** | (2006.01) |
| ***B65C 9/00*** | (2006.01) |
| ***B65C 11/00*** | (2006.01) |

(52) U.S. Cl.

CPC ..... *B65C 9/18* (2013.01); *B65C 9/0006* (2013.01); *B65C 9/26* (2013.01); *B65C 11/00* (2013.01)

(58) Field of Classification Search

CPC . B65C 9/18; B65C 9/0006; B65C 2009/0009; B65C 2009/0087; B65C 2210/0078

See application file for complete search history.

(56) References Cited

U.S. PATENT DOCUMENTS

| | | | | |
|---|---|---|---|---|
| 5,941,413 | A * | 8/1999 | Roman | B65C 11/00 221/73 |
| 5,980,138 | A * | 11/1999 | Shiozaki | B41J 2/32 400/582 |
| 6,092,945 | A * | 7/2000 | Takami | B41J 3/4075 400/613 |
| 7,284,992 | B2 * | 10/2007 | Becker | H01L 23/3675 257/E23.065 |
| 2004/0079490 | A1 * | 4/2004 | Ito | B41J 3/44 156/764 |

(Continued)

*Primary Examiner* — Philip C Tucker
*Assistant Examiner* — John Blades
(74) *Attorney, Agent, or Firm* — The Watson IP Group, PLC; Jovan N. Jovanovic

(57) ABSTRACT

A label dispenser apparatus configured for dispensing labels from a plurality of rolls of a carrier film having labels disposed thereon. The label dispenser apparatus includes a lower roll retaining member and a upper tape guide assembly. The lower roll retaining member includes a front edge, a back edge and a concave surface therebetween. The concave surface being configured to cradle a roll of film having labels disposed thereon. The upper tape guide assembly is spaced apart therefrom and includes a peel shaft, a support shaft and a carrier shaft. The film guide path extends behind and around the peel shaft, between the peel shaft and the support shaft, looping around the support shaft and over the carrier shaft, such that a label is released by the movement around the peel shaft, and the label path proceeds directly over the support shaft and the carrier shaft.

6 Claims, 12 Drawing Sheets

(56) References Cited

U.S. PATENT DOCUMENTS

2009/0120578 A1* 5/2009 Ogawa ..... B65C 11/0289
156/715

* cited by examiner

LABEL DISPENSER APPARATUS

CROSS-REFERENCE TO RELATED APPLICATION

This application claims priority from U.S. Pat. App. Ser. No. 62/233,457 filed Sep. 28, 2015, entitled "Label Dispenser Apparatus," the entire specification of which is hereby incorporated by reference. Additionally, this application is a continuation in part of U.S. patent application Ser. No. 14/680,896 filed Apr. 7, 2015, entitled "Label Dispenser Apparatus," which claims priority from U.S. Pat. App. Ser. No. 61/976,402 filed Apr. 7, 2014, entitled "Label Dispenser Apparatus," with the entire specification of both of these applications incorporated herein in their entirety.

BACKGROUND OF THE DISCLOSURE

1. Field of the Disclosure

The invention relates in general to dispensing apparatuses, and more particularly, to a label dispenser apparatus which is configured to retain at least one, and preferably a plurality of label rolls, allowing the dispensing of individual labels from the label roll.

2. Background Art

The use of dispensers is known in the art. It is often the case that a rolled film is released from a roll and dispensed at a particular rate (i.e., in short pieces, etc.). A number of labels are often provided on a web or film (carrier liner), with the labels being positioned thereon in a repeating pattern.

There has been a deficiency in the art with respect to the dispensing of such label rolls. For example, many are manually unrolled with the user peeling a sticker manually. This is quite cumbersome. In other instances the application has been done with a machine (hand held, or otherwise). In each instance, there are drawbacks.

Thus, it is an object of the disclosure to provide an improved manner in which to dispense labels from a label roll.

It is another object of the disclosure to provide an improved manner in which to store labels and label rolls.

It is another object of the disclosure to provide a manual food wrapping machine integrated with a label apparatus.

It is another object of the disclosure to provide a label apparatus which does not include an axle or other member extending through the roll so that rolls can be placed side by side and removed as desired without disrupting the entire structure or the adjacent label rolls.

SUMMARY OF THE DISCLOSURE

A label dispenser apparatus configured for dispensing labels from a plurality of rolls of film having labels disposed thereon. In such an aspect of the disclosure, the label dispenser apparatus has at least one label dispensing unit that includes a lower roll retaining member and an upper tape guide assembly. The lower roll retaining member extends from a first side to a second side. The lower roll retaining member includes a front edge, a back edge and a concave surface therebetween. The concave surface is configured to cradle a roll of film having labels disposed thereon. The upper tape guide assembly is spaced apart from the lower roll retaining member and extends from the first side to the second side, in a configuration that is substantially parallel to the lower roll retaining member. In turn, a space is defined therebetween for positioning of a roll of film having labels disposed thereon.

The upper tape guide assembly further comprising a upper confining member, a peel shaft and a support shaft. The upper confining member extends from the first side to the second side and has a front edge substantially corresponding to a lower roll retaining member front edge. The peel shaft includes a rod that extends substantially parallel to the upper confining member, spaced apart therefrom, and spaced apart from a front edge of the upper confining member. The support shaft extends generally parallel to the peel shaft and is positioned outboard of the peel shaft.

A label guide path is defined to extend between the upper confining member and the peel shaft, and between the peel shaft and the support shaft. A label is released by the movement around the peel shaft, to, proceed between the upper confining member and the support shaft, while the film proceeds between the peel shaft and the support shaft, thereby separating the label from the film and facilitating the grasping thereof by a user.

In some configurations, the label roll is free from a structure extending through the hoop defined thereby. As a result, removal of the label roll from within the label dispensing unit is facilitated without first removing a structure that extends through a hoop defined thereby.

In some configurations, the apparatus further includes a pivot shaft extending between the first side and the second side. The pivot shaft is positioned between a back edge and the peel shaft and positioned in a spaced apart orientation relative to the upper confining member. A separator blade includes a first end having an opening extending therethrough, and a second end spaced apart therefrom. The pivot shaft extends through the opening such that the separator blade pivots therearound, with the second end being selectively pivotable so as to rest on the lower roll retaining member, and being pivotable therefrom.

In some configurations, a plurality of separator blades are positioned in a spaced apart relationship along the pivot shaft.

In some configurations, the opening of the separator blade comprises a snap on opening. Such a snap on opening can be snapped over the pivot shaft to facilitate coupling and decoupling therefrom selectively, and removal without necessitating the sliding along the pivot shaft to an end thereof.

In some configurations, the label guide path extends between the pivot shaft and the upper confining member prior to extending between the peel shaft and the upper confining member.

In some configurations, the separator blade includes a finger extending from the first end toward a back edge, when the second end of the separator blade is positioned to engage with the lower roll retaining member.

In some configurations, the concave surface of the lower roll retaining member further includes a central valley, with a front inclined surface extending therefrom toward the front edge, and terminating with a front lip, and a back inclined surface extending from the central valley toward the back edge, and terminating with a back lip.

In some configurations, the front inclined surface extends approximately two thirds of the distance from the central valley to the front lip. The back inclined surface extends approximately two thirds of the distance from the central valley to the back lip.

In some configurations, the upper confining member further includes a concave region that is concave in a downward and outward direction, and a planar region extending from the concave region to the front edge. The peel shaft is positioned proximate the concave region, and the support shaft positioned proximate the planar region.

In some configurations, a plurality of label dispenser units are positioned in a vertically stacked orientation. In such a configuration, the upper tape guide assembly of a first of the plurality of dispenser units and the lower roll retaining member of an immediately adjacent label dispenser unit are an integrally formed profile.

In some configurations, the integrally formed profile comprises an extruded member.

In some configurations, the plurality of label dispenser units are positioned within a cabinet having a back wall and defining an inner surface associated with the back edge of the label dispensing unit.

In some configurations, a product wrapping station being positioned below a lowest one of the label dispenser units.

In some configurations, a portion of the product wrapping station extends into the cabinet.

In some configurations, the support shaft is positioned between the peel shaft and a upper tape guide assembly front edge. The peel shaft has a plurality of dispenser rollers rotatably positioned about the support shaft in a generally side by side orientation.

In some configurations, the support shaft is defined by a door having an inner surface and an outer surface. The door extends at least partially from the first side to the second side, and is configured to extend toward the lower roll retaining member.

In some configurations, the door further includes a lower knife edge.

In some configurations, the door comprises at least a partially transparent member extending to the front edge of the lower roll retaining member. The film extends between the front edge of the lower roll retaining member and the door.

In another aspect of the disclosure, the disclosure is directed to a label dispenser apparatus configured for dispensing labels from a plurality of rolls of a carrier film having labels disposed thereon. The label dispenser apparatus has at least one label dispensing unit that includes a lower roll retaining member, and an upper tape guide assembly. The lower roll retaining member extends from a first side to a second side. The lower roll retaining member includes a front edge, a back edge and a concave surface therebetween. The concave surface is configured to cradle a roll of film having labels disposed thereon.

The upper tape guide assembly is spaced apart from the lower roll retaining member extending from the first side to the second side, in a configuration that is substantially parallel to the lower roll retaining member, thereby defining a space therebetween for positioning of a roll of film having labels disposed thereon. The upper tape guide assembly further includes a peel shaft, a support shaft and a carrier shaft. The peel shaft comprises a rod that extends substantially parallel to the back edge of the lower roll retaining member, and that is configured to be above the plurality of rolls of carrier film having labels disposed thereon. The support shaft extends generally parallel to the peel shaft positioned outboard of the peel shaft, and vertically closer to the lower roll retaining member. The carrier shaft extends generally parallel to the peel shaft and the support shaft, and is positioned so as to be substantially proximate the front edge of the lower roll retaining member and configured to be above the plurality of rolls of carrier film having labels disposed thereon. A film guide path is defined to extend behind and around the peel shaft, then between the peel shaft and the support shaft, looping around the support shaft so as to extend over the carrier shaft. As such, a label is released by the movement around the peel shaft, and the label path proceeds directly over the support shaft and the carrier shaft.

In some configurations, the support shaft and the carrier shaft are generally parallel to each other and generally equidistantly spaced from the lower roll retaining member.

In some configurations, the peel shaft is positioned so as to be further from the lower roll retaining member than the support shaft.

In some configurations, the peel shaft is positioned relative to the support shaft so that the carrier film is configured to extend approximately half way around the peel shaft.

In some configurations, the peel shaft is positioned proximate a back wall that extends upwardly from the rear edge of the lower roll retaining member, to, in turn, be configured to allow the carrier film to extend from the roll substantially parallel to the back wall to the peel shaft.

In some configurations the peel shaft is maintained in tension. In some such configurations, the tension in the peel shaft can be adjusted

BRIEF DESCRIPTION OF THE DRAWINGS

The disclosure will now be described with reference to the drawings wherein.

DETAILED DESCRIPTION OF THE DISCLOSURE

Figure 1:
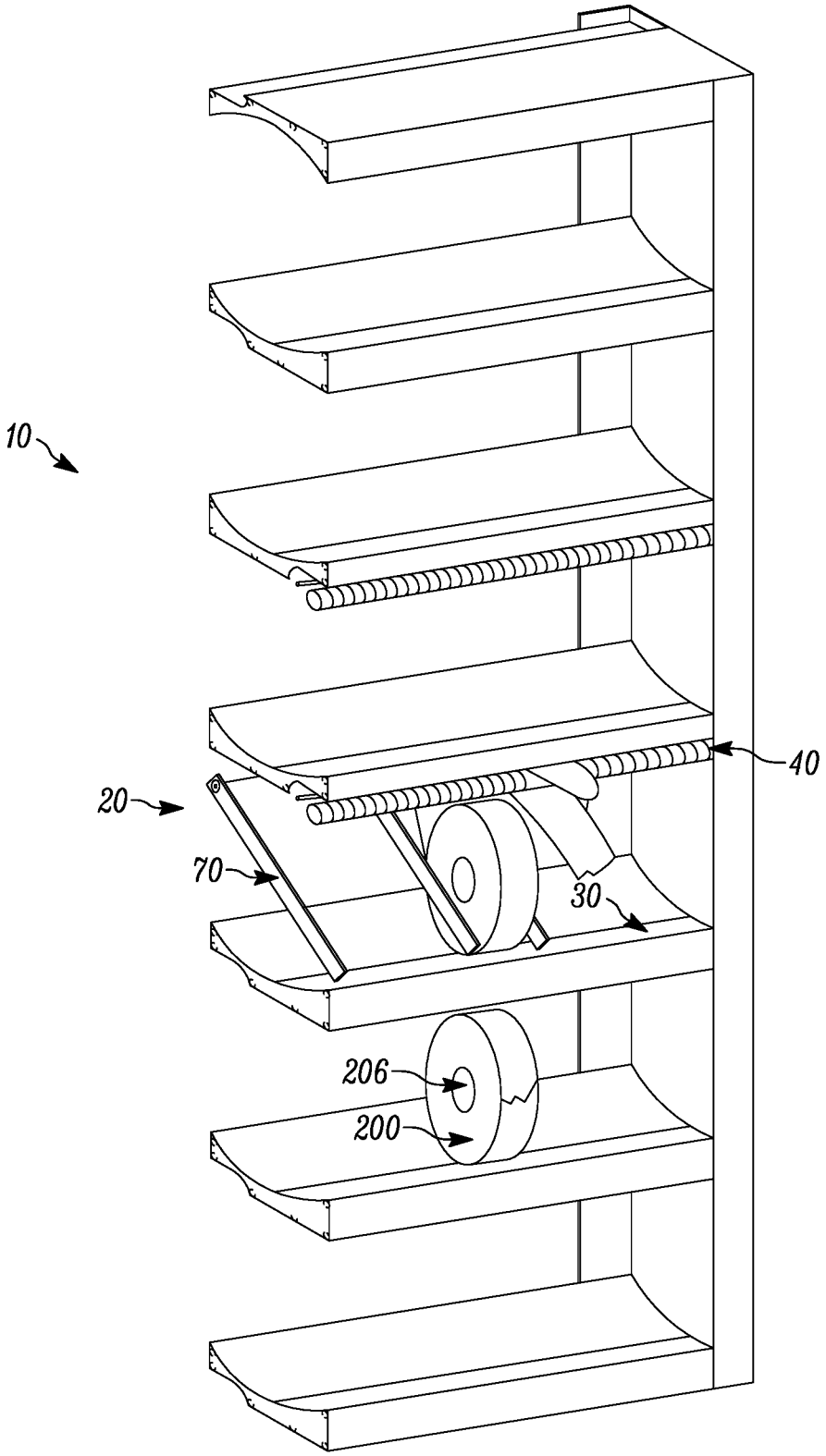
FIG. 1 of the drawings is a partial perspective view of the label dispenser apparatus of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 3A:
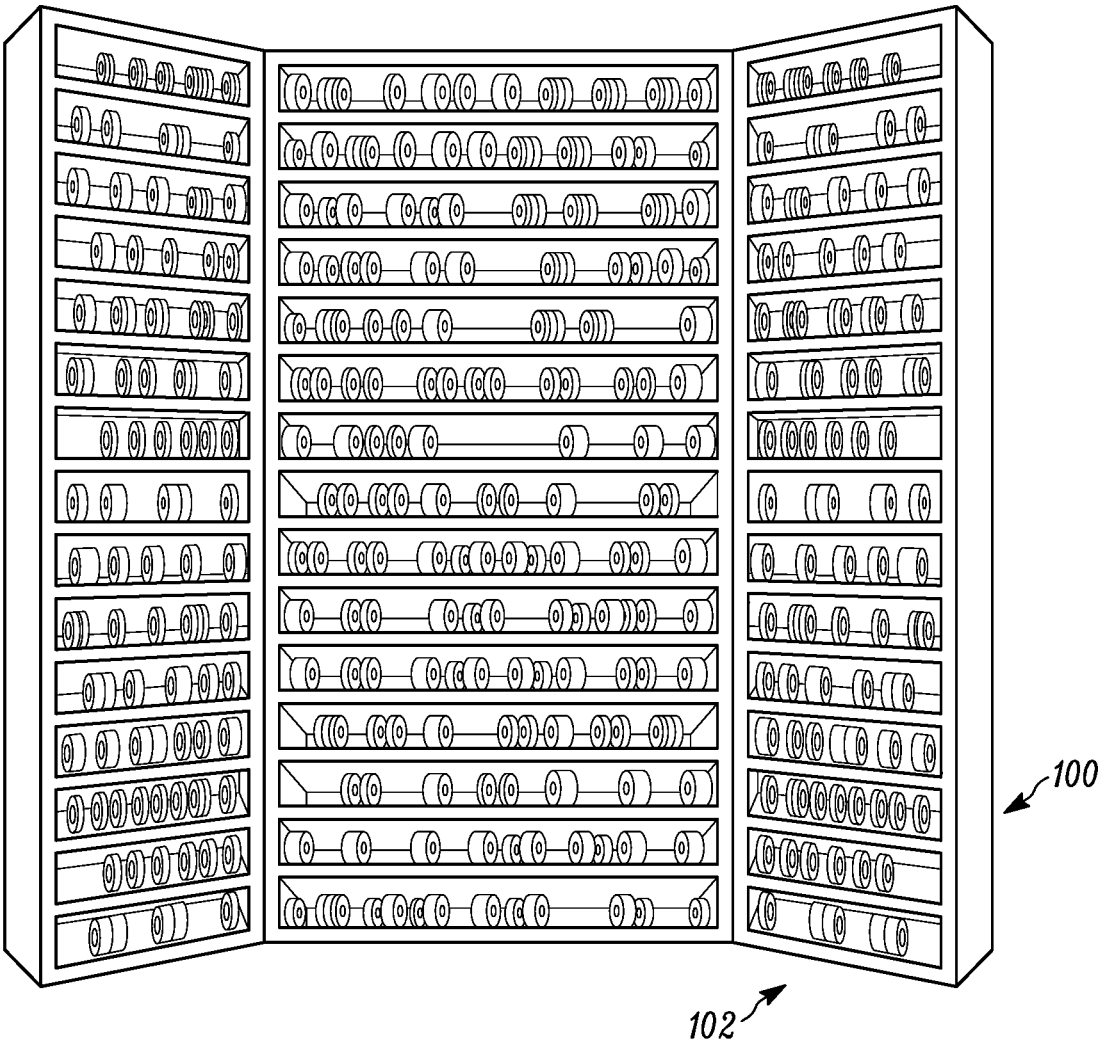
FIG. 3*a* of the drawings is a perspective view of a cabinet configured with the label dispenser apparatus of the present disclosure, showing, in particular, an open configuration.
Figure 3B:
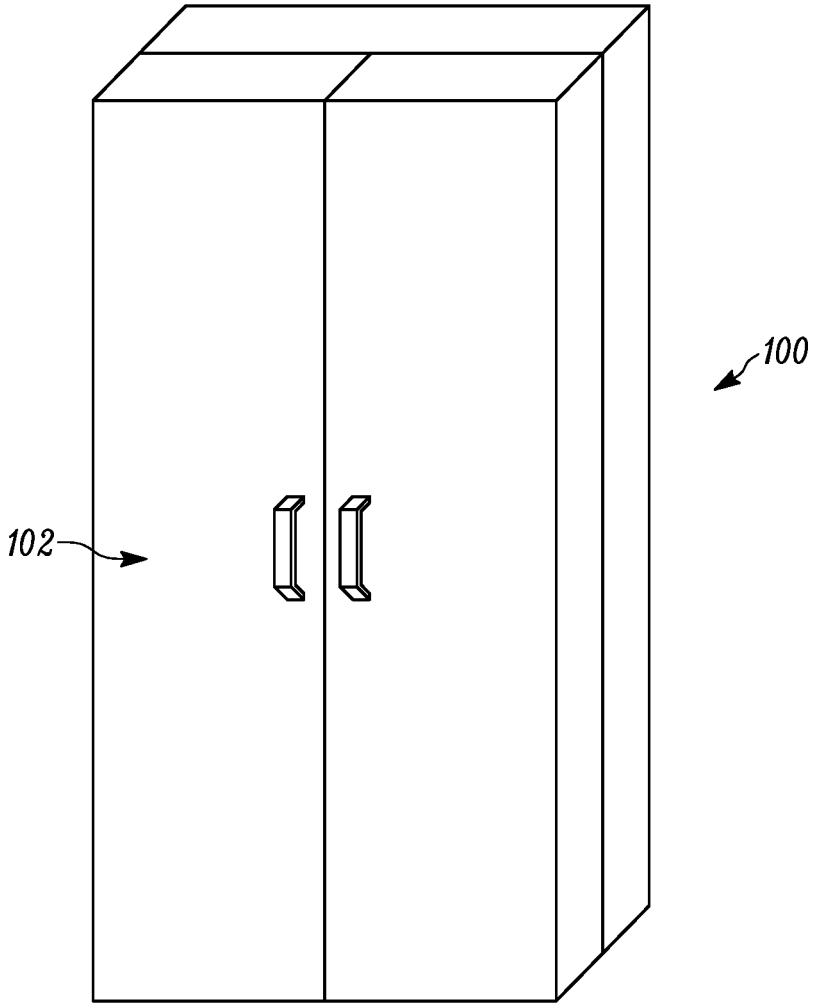
FIG. 3*b* of the drawings is a perspective view of a cabinet configured with the label dispenser apparatus of the present disclosure, showing, in particular, a closed configuration.

Referring now to the drawings and in particular to FIG. 1, the label dispenser apparatus is shown generally at 10. It will be understood that, as shown, the label dispenser apparatus 10 is configured to retain and dispense a plurality of labels from a plurality of rolls, and, with reference to FIGS. 3*a* and 3*b*, can be configured to be housed within cabinet 100 (and form a part thereof), having doors 102. It will be understood that the apparatus may be configured for as few as a single roll, or may be configured for dozens of rolls. This may be on a single label dispensing unit (i.e., a single row of labels), or multiple label dispensing units which are positioned on several adjacent rows. The particular quantity and size of the label dispensing units is unlimited, as is the orientation.

Figure 2:
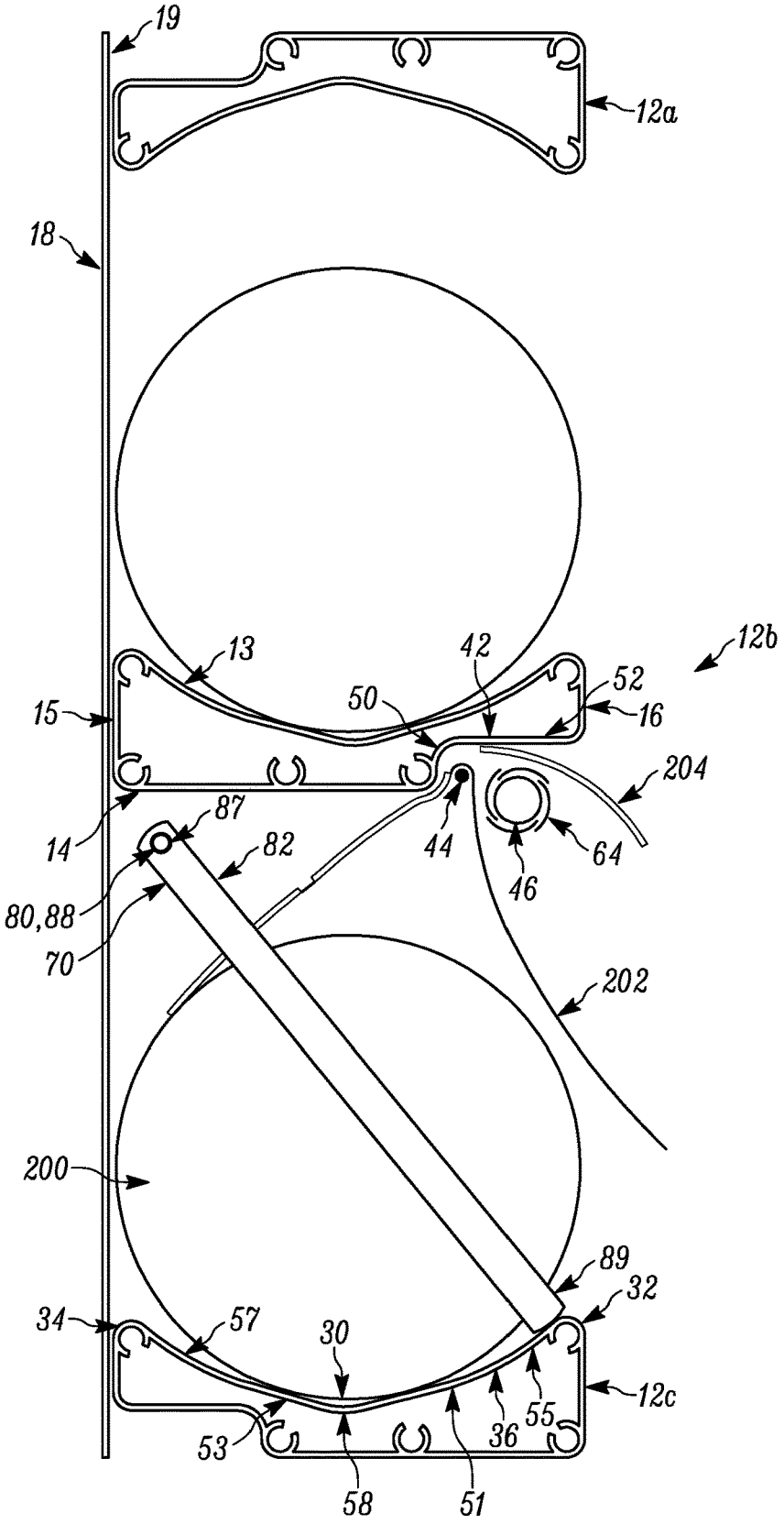
FIG. 2 of the drawings is a partial side elevational view of an embodiment of the label apparatus of the present disclosure.

The configuration shown in FIG. 2 includes a pair of label dispensing units which are defined by three extrusion profiles, namely profiles 12*a*, 12*b* and 12*c* that extend generally parallel to each other and from a first side to a second side (often within a cabinet or the like, while not required). Such a configuration is configured for carrying two rows of label rolls, one above the other. It will be understood that profile 12*a* comprises an uppermost profile and profile 12*c* comprises a lowermost profile. The profile 12*b* is positioned between the two other profiles, and comprises a central profile. It will be understood that a plurality of central profiles can be provided between the uppermost and the lowermost profile. Alternatively, the same central profile can be utilized for each of the levels, thereby minimizing the different profiles that need to be manufactured. It will be understood that for the uppermost profile and the lowermost profile, certain structures may not be utilized or necessary.

As profile 12*b* comprises the central profile, it will be discussed in greater detail with the understanding that the remaining profiles may be identical or may have certain omissions or additions of features. Profile 12*b* is configured to include top 13, bottom 14, proximal end 15 and distal end 16. The profile 12*b* is coupled by way of its proximal end 15 to a wall, such as wall 18, and in particular, to the inner surface 19 thereof. The wall 18 may comprise a part of the cabinet 100. Generally, the profiles are extrusions, which may be subsequently machined or otherwise modified. It will be understood that cast members as well as molded members are likewise contemplated for use. While it is contemplated that the profiles comprise a metal member (such as, for example, an aluminum), other members are likewise contemplated for use.

It will be understood that, generally, a label dispensing unit 20 is defined by the top surface of a lower extrusion profile and a bottom surface of an upper extrusion profile. It will also be understood that label dispensing units may be stacked upon each other so that three extrusions can define two label dispensing units, whereas four extrusions can define three label dispensing units, and so on. Each dispensing unit may be varied in length and size (i.e., longer or shorter, larger rolls, smaller rolls). Indeed, any combination of differently configured dispensing units is contemplated for use. Some extrusions may take into account a larger label roll above an extrusion, and a smaller label roll below an extrusion. Thus, while certain profiles are shown, other profiles are likewise contemplated. In addition, while the profiles are shown to be a single member, it is contemplated that each extrusion may comprise a plurality of materials.

The label dispensing unit 20 will be described with the understanding that other label dispensing units are similar in configuration (although they may be structurally distinct and dimensionally distinct). The label dispensing unit 20 comprises lower roll retaining member 30, upper tape guide assembly 40 and separator assembly 70. As is shown, the lower roll retaining member 30 is generally formed from and proximate the top of extrusion profile 12*a*. The upper tape guide assembly 40 is formed from and proximate the bottom of the extrusion profile 12*b*.

The lower roll retaining member 30 is shown in FIG. 2 as comprising front edge 32, back edge 34 and concave surface 36. The back edge 34 generally coincides with the proximal end 15 of the profile and the front edge 32 generally coincides with the distal end 16 of the profile. The concave surface 36 is configured to receive a label roll. The concave surface defines a trough which includes central valley 58 which is generally spaced apart from the front edge 32 and the back edge 34, and generally parallel to each. Between the front edge 32 and the central valley 58, the profile includes a plurality of regions. Extending from the central valley toward the front edge, a front inclined surface 51 (generally substantially planar) is positioned. That surface extends approximately half to two thirds of the distance between the central valley 58 and the front edge. From there, front lip 55 extends from the front inclined surface 51 to the front edge 32. The front lip 55 is generally angled more steeply relative to the front incline. Additionally, the front lip may be of an arcuate configuration, that may match or mimic the general configuration of the label roll.

Similarly, extending from the central valley 58 toward the back edge 34, a back inclined surface 53 is positioned. That surface extends approximately half to two thirds of the distance between the central valley 58 and the back edge 34. From there, back lip 57 extends from the back inclined surface 53 to the back edge 34. The back lip 57 is generally angled more steeply relative to the back incline. Additionally the back lip may be of an arcuate configuration, that may match or mimic the general configuration of the label roll. In the embodiment shown, the concave structure is substantially symmetrical about the central valley 58. In other embodiments, it is contemplated that the structure may be asymmetrical.

The upper tape guide assembly 40 is shown in FIG. 2 as comprising upper confining member 42, peel shaft 44 and support shaft 46. The upper confining member 42 includes concave region 50 and a planar region 52. The concave region 50 extends outwardly and downwardly, with the planar region being substantially perpendicular to the wall 18. The planar region extends from the concave region. The concave region may comprise a segment that corresponds to approximately a quarter of a circle. Generally, the concave region is positioned forward of the central valley 58 so that it corresponds to somewhere proximate the interface between the front incline 51 and the front lip 55. While not limited thereto, the radius of curvature of the concave region may be substantially uniform.

The peel shaft 44 is positioned below the concave region proximate, for example, the center of the radius that defines the concave region. That is, the peel shaft substantially corresponds to the bottom of the concave region, and under the interface of the concave region with the planar region. The peel shaft comprises a rod or shaft that is in tension so that it remains substantially parallel to the profiles. The concave region and the peel shaft together defines an arcuate pathway for the label roll to extend through. The peel shaft extends from the first end of the profile to the second end of the profile.

The support shaft 46 is shown in FIG. 2 as comprising a plurality of discrete dispenser rollers 64, all of which are positioned in a side by side orientation and which are rotatable about a substantially identical axis of rotation. The support shaft 46 extends between a first end of the profile and the second end of the profile. Generally, the dispenser roller comprises a larger diameter than the peel shaft and is spaced apart from the peel shaft a predetermined distance, defining a passageway for the film, or carrier liner, of the label roll. In the embodiment shown, the upper end of each of the peel shaft and the support shaft generally correspond to each other. The dispenser rollers 64 and the planar region 52 of the upper confining member 42 cooperatively define a label separation and passage region.

Figure 4:
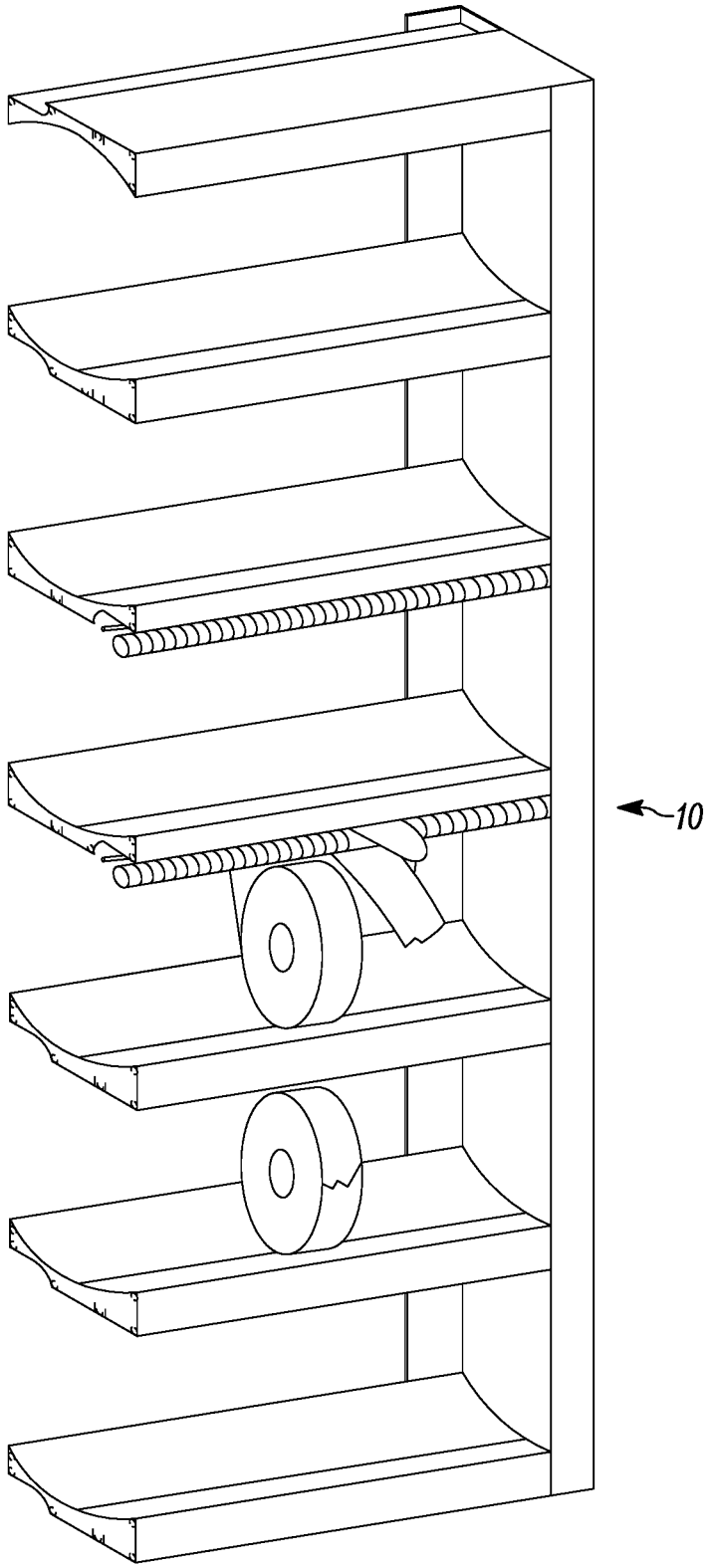
FIG. 4 of the drawings is a partial perspective view of an embodiment of the label apparatus of the present disclosure, omitting a separator assembly.
Figure 5:
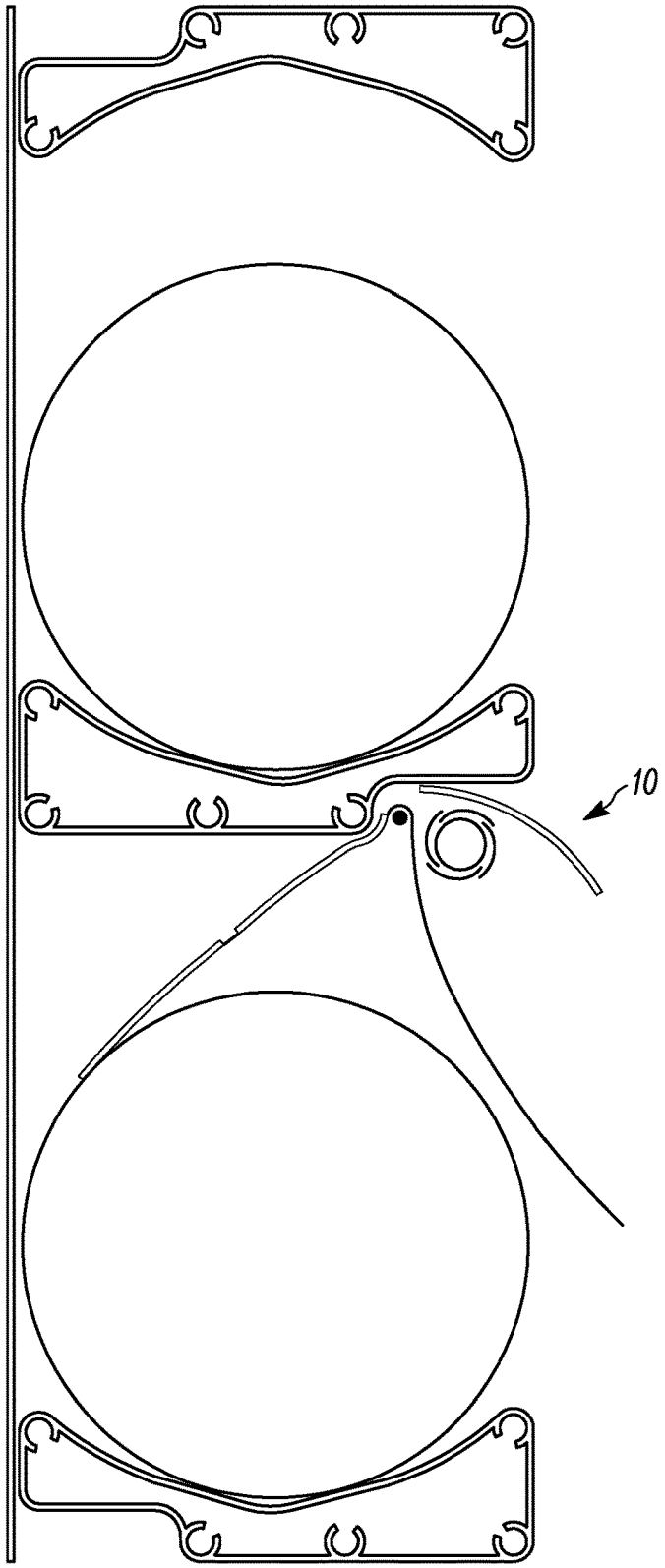
FIG. 5 of the drawings is a partial side elevational view of an embodiment of the label apparatus of the present disclosure, omitting a separator assembly.

The separator assembly 70 is shown in FIG. 2 as comprising pivot shaft 80 and separator blades 82. The pivot shaft extends from the first end to the second end of the profile and is positioned proximate the bottom of an extrusion profile spaced apart therefrom and spaced apart from the wall a distance. The separator blades 82 include a first end 87 and a second end 89 spaced apart therefrom. Generally, the blades 82 comprise a substantially elongated thin member. At the first end, opening 88 extends through the blade 82. The opening is configured so that the pivot shaft extends therethrough. As a result, the blade 82 pivots about the pivot shaft 80 and opening 88. It will be understood that the pivot shaft pivot is generally spaced above the top of the label roll, and configured to be positioned between label rolls that are desired to be separated. It will be understood that the separator assembly may be omitted entirely from other embodiments (i.e., the embodiment of FIGS. 4 and 5).

The operation of the label dispenser apparatus will be described with respect to the embodiment shown in FIG. 2, with respect to a single label roll. It will be understood that the same principles and operation can be applied to a plurality of label rolls in a side by side configuration or a spaced apart configuration on a single label dispensing unit or spread over a number of label dispensing units.

More particularly, to operate the label dispenser apparatus, a label roll is provided. One exemplary label roll is shown in FIG. 2, generally, as comprising support tube 206 upon which a carrier liner 202 is wound, the carrier liner 202 having a plurality of labels placed thereon in a spaced apart orientation. Generally, the label rolls may be anywhere from an inch to four inches in diameter and between a quarter of an inch and two inches in width (although other configurations are contemplated, and these are not to be deemed limiting).

The label roll is introduced into the label dispensing unit 20. In particular, the label roll is placed on the lower roll retaining member 30. Due to the configuration of the concave surface 36, the label roll that is placed on the concave surface will roll forward and/or backward and eventually settle within the central valley 58 and have tangential contact on the front incline 51 and the back incline 53. Preferably, the label roll is spaced apart from the front and back lips 55, 57, although some contact may be unavoidable and/or permissible, depending on the diameter of the label roll.

Once positioned, where separation is desired, a plurality of separator assemblies, such as separator assembly 70, can be utilized. For example, a separator blade 82 can be rotated upward so as to be outside of the bounds of the label roll and slid along the pivot shaft 80 until the proper abutting relationship is reached with the label roll (or until a desired position is reached). At such time the separator blade can be rotated downwardly until the second end thereof contacts the lower roll retaining member. Multiple separator blades can be utilized, for example, with one positioned on either side of the label roll. In other instances, the label rolls may be adjacent each other, with the separator blades separating groups of labels and the like. In other embodiments, the separator assembly can be completely omitted.

Next, the end of the label roll is threaded between the peel shaft and the concave region of the upper confining member. In such a configuration, the roll is guided by both structures so as to remain therebetween. Further, the label roll follows the concave region and then is directed downwardly between the peel shaft and the support shaft. In such a configuration, the carrier liner undergoes a bend that is semi-circular. This defines the tape path through the upper tape guide assembly.

Such a tight configuration with a bend through such a small radius will tend to dislodge the label from the carrier liner. As such, the label will not follow the label carrier between the peel shaft and the support shaft. To the contrary, the label will continue between the planar region 52 and the dispenser rollers 64, and may be in contact with each, eventually releasing onto the dispenser rollers 64.

As the user pulls the carrier liner, the label is released and extends through the region between the upper confining member and the support shaft. The label will typically come to rest on the dispenser roller. It will be understood that the dispenser roller will be configured with a surface which can engage the adhesive of the label, while allowing releasable engagement (i.e., such attraction is preferably not permanent). At the same time, due to the configuration of the tape roll, the front lip and the back lip confine the label roll within the desired position on the concave surface. Additionally, with the contact being substantially tangential between the label roll and the front incline and back incline the drag on the label roll is minimized due to the contact with the concave surface of the lower roll retaining member.

The carrier liner continues between the peel shaft and the support shaft. Eventually, as the carrier liner becomes longer, it can be cut and discarded. However, a certain length is desired, such that, at all times, the label roll is ready for use with the next label being in position to be released.

Finally, it will be understood that other labels can be configured in a similar manner throughout the cabinet. Again, it will be understood that, in the place of a cabinet, a single dispenser, or a single row of label rolls may be utilized on a desk or other table surface (i.e., a more compact design). It will further be understood that the label roll of film is supported within the lower roll retaining member, and it is not necessary to extend any member through the center of the label roll to maintain the desired position. Thus, the insertion and removal of adjacent label rolls can be accomplished without needing to remove a central shaft or the like prior thereto that extends through the hoop defined by the label roll.

Figure 6:
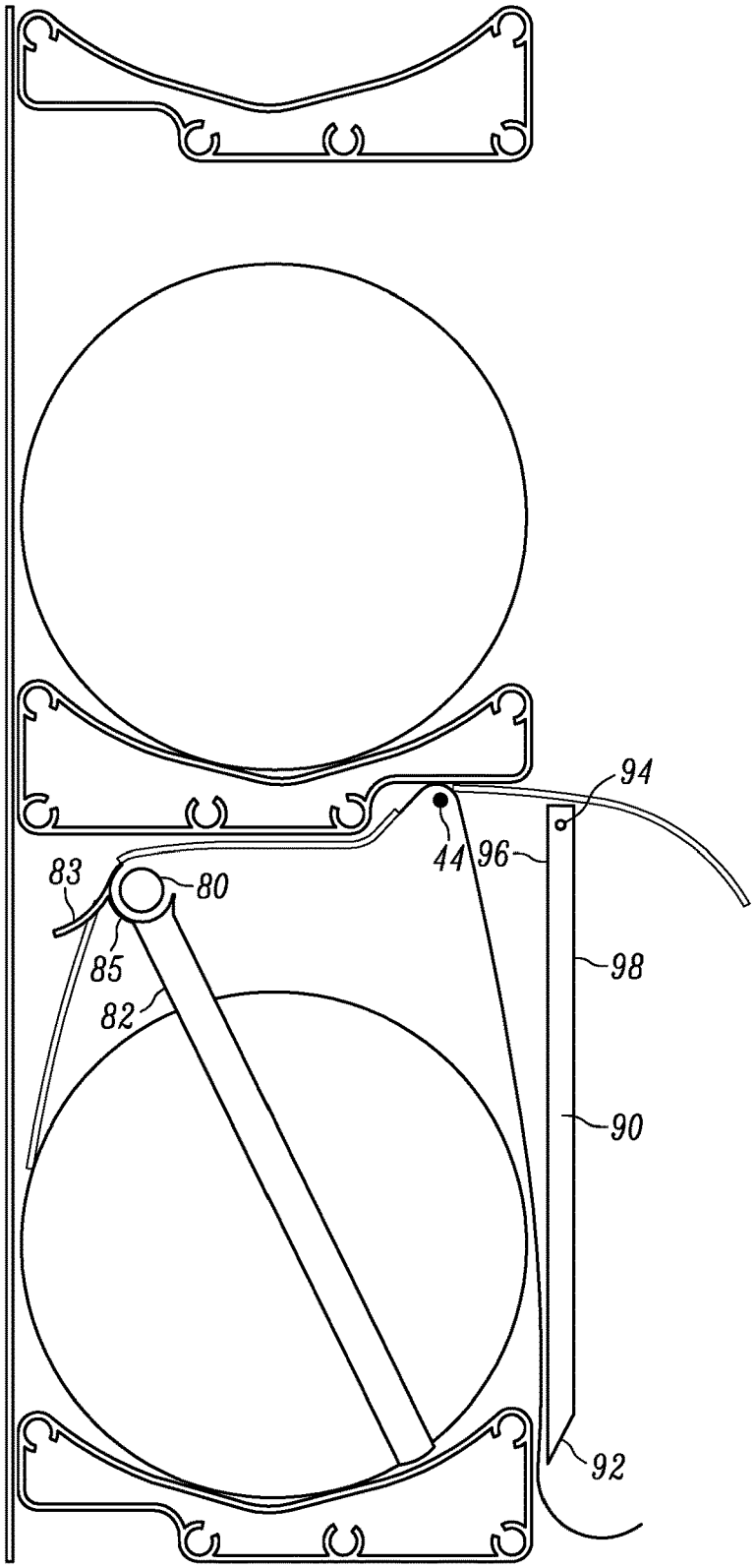
FIG. 6 of the drawings is a partial side elevational view of another embodiment of the label apparatus of the present disclosure, showing, in particular, a front door in place of the support shaft, and including another embodiment of the separator assembly.

In another embodiment of the disclosure, as is shown in FIG. 6, the upper tape guide assembly does not include dispenser rollers, and a door 90 is provided to pivot about the support shaft (and may be integrally formed therewith). The door 90 is pivotably positioned so as to extend in front of the roll of labels and between the two extrusions. The door 90 pivots about axis 94 (defining the support shaft) and includes inner surface 96 and outer surface 98, along with lower knife edge 92. It will be understood that the door is spaced apart from the peel shaft 44.

In such an embodiment, the door is preferably transparent so that the contents behind the door are fully visible. In operation, the user threads the label carrier liner around the larger pivot shaft (which is of a larger diameter than in the prior embodiments), along the lower surface of the extrusion, around the peel shaft and then down behind the door 90 exiting proximate the knife edge 92. It is helpful that the label and the label carrier extend and interface with the lower surface of the extrusion.

As the label carrier liner is pulled, due to the tight turn around the peel shaft, the label is removed from adherence to the carrier liner and exits above the door in the slot defined by the extrusion immediately above the peel shaft and the door itself. The label can easily be retrieved from such a position. Further pulling of the carrier liner sequentially directs labels through the slot.

When the user no longer desires labels, or when the carrier liner becomes excessively long, the user can cut the carrier liner using the knife edge 92 of the door. Due to the material of the carrier liner, and the relatively small radius of the peel shaft, once the carrier liner is cut, the carrier liner will tend to roll upon itself in a loop of a small diameter and gather proximate the peel shaft. As such, the user can easily see through the door at the label roll to determine the remaining stock of the label roll.

The separator blades 82 of the separator assembly 70 include snap on opening 85 which is configured to be removably coupled to the pivot shaft, and also allows the separator blade to slide along the pivot shaft. A finger extension 83 extends from the separator blade 82 toward the back wall. The finger extension 83 prevents the label carrier from hopping over or snapping on the guides, thereby keeping the label carrier in the preferred orientation and precluding inadvertent jamming, sliding or other undesirable movement.

Figure 7:
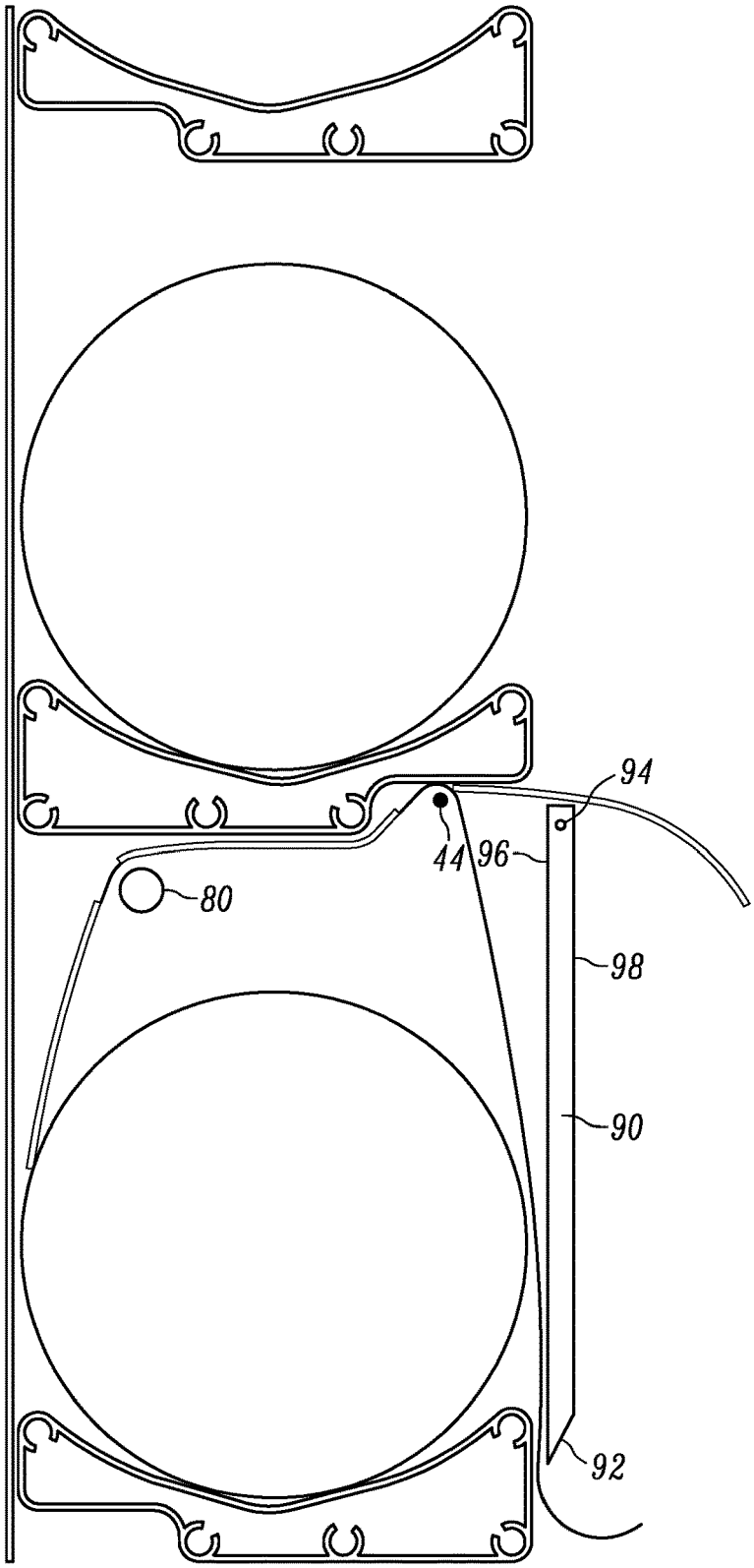
FIG. 7 of the drawings is a partial side elevational view of another embodiment of the label apparatus of the present disclosure, showing, in particular, a front door in place of the support shaft, while omitting a separator assembly.

The embodiment of FIG. 7 is substantially identical to the embodiment of FIG. 6, with the separator blades being omitted. It will be understood that the separator blades may be incorporated into the embodiments as desired. Advantageously, with the configuration of the separator blades in FIG. 6, the blades can be easily removed or replaced onto the pivot shaft.

Figure 8:
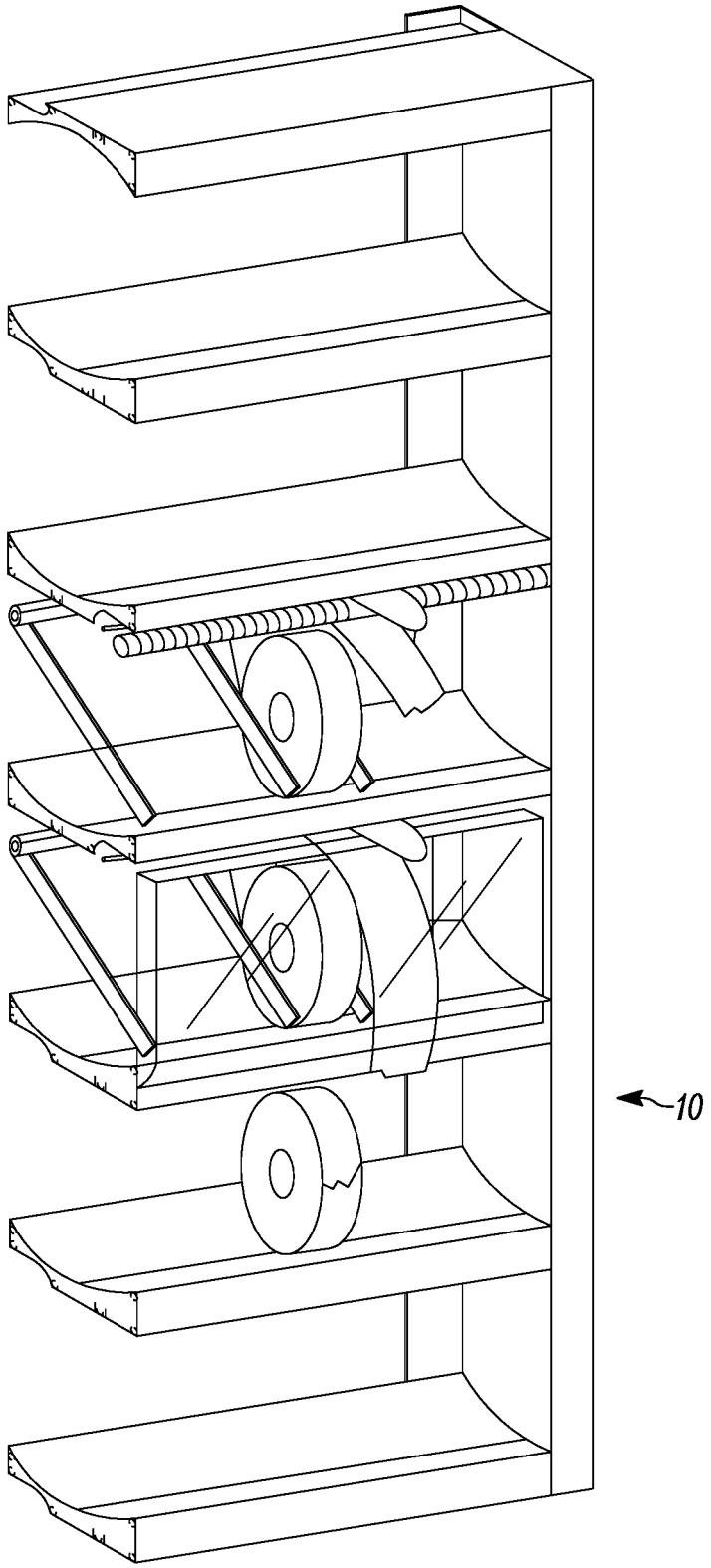
FIG. 8 of the drawings is a perspective view of an embodiment of the label apparatus of the present disclosure, showing, in particular, the door assisting with the dispensing of the label.
Figure 9:
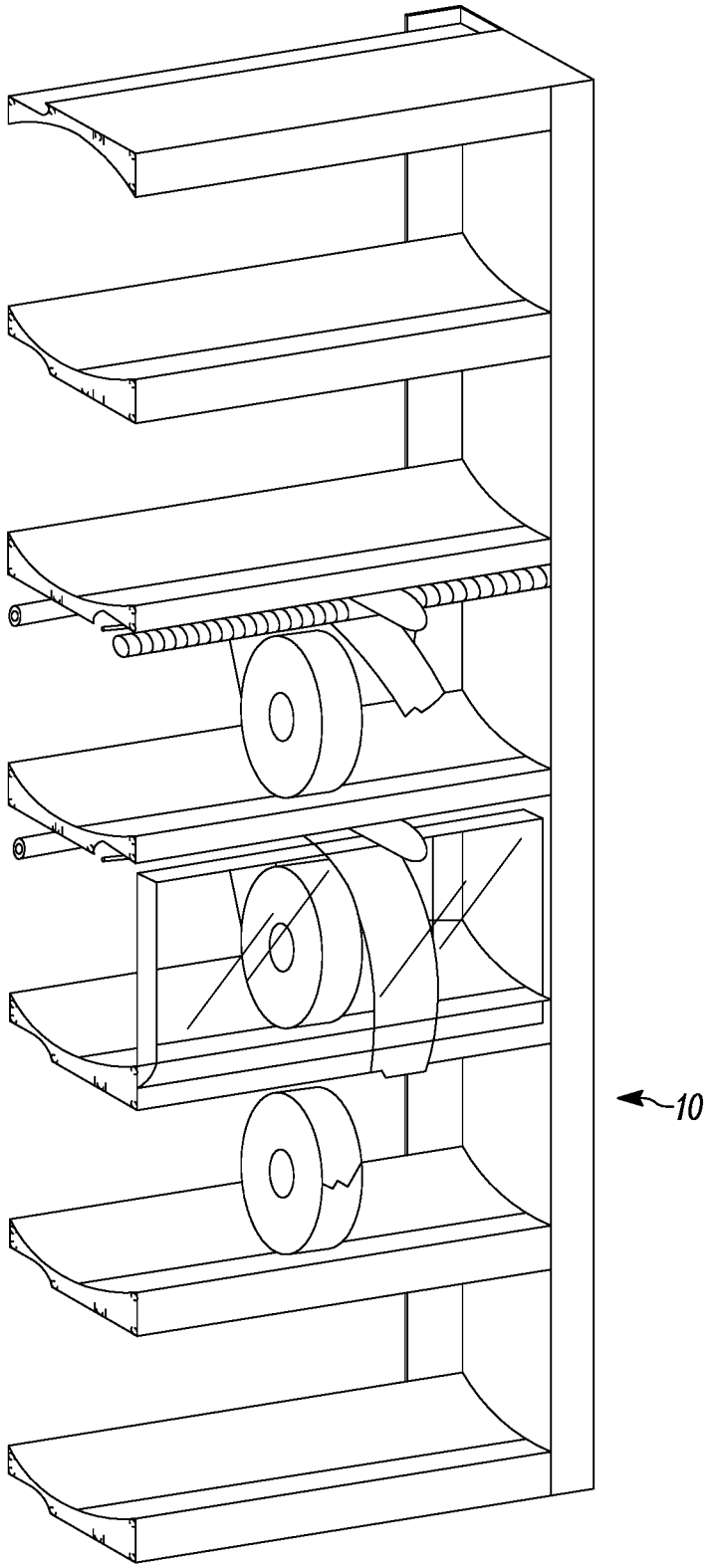
FIG. 9 of the drawings is a perspective view of the embodiment of FIG. 8, omitting the separator assembly.

FIGS. 8 and 9 show embodiments where the different rows include different mechanisms for dispensing. For example, the embodiment including the support shaft is shown along with an embodiment including the door in place of the support shaft is shown. In FIG. 8, such a configuration is shown with the use of separator blades. In FIG. 9, such a configuration is shown without separator blades.

Figure 10:
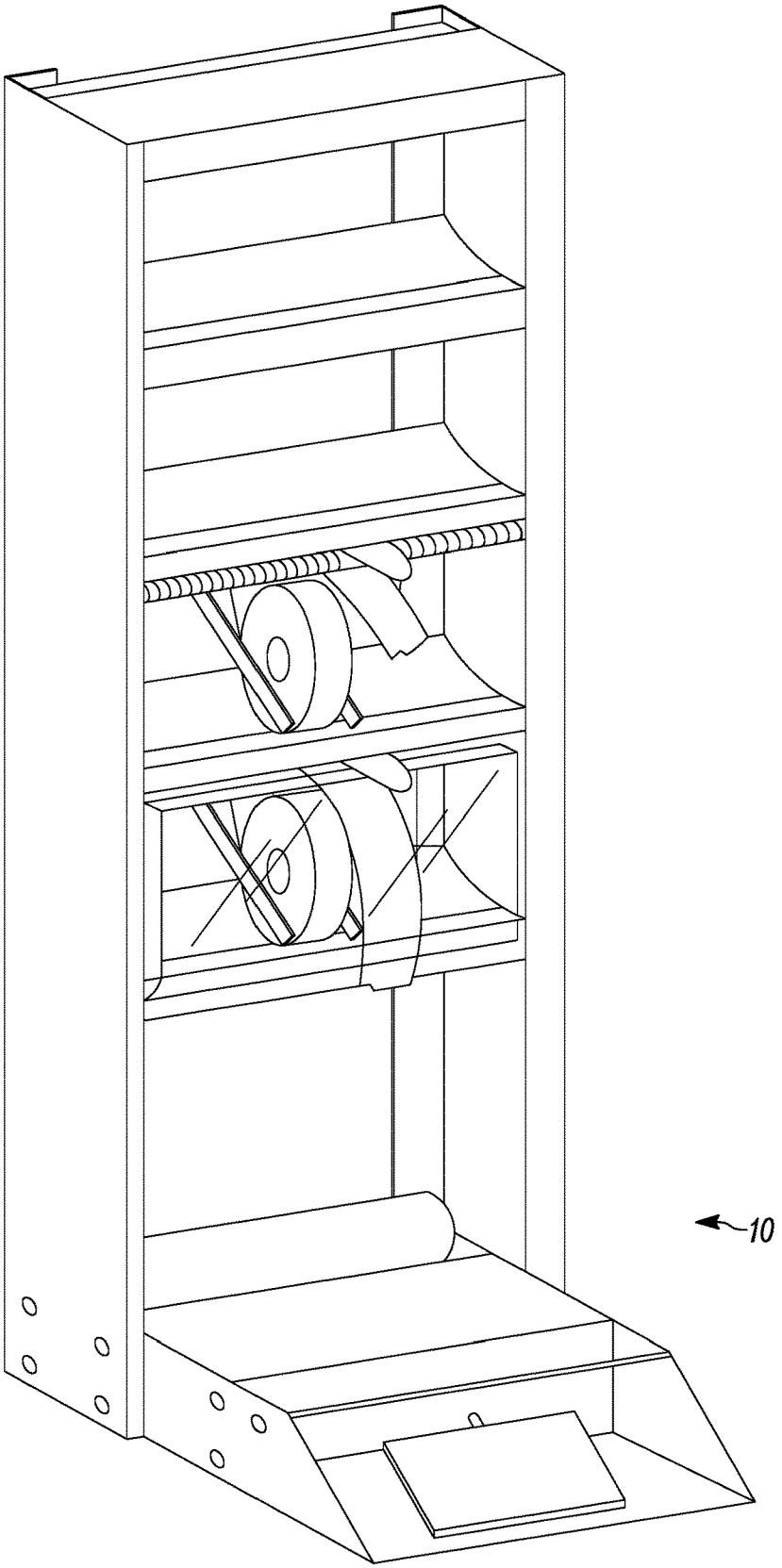
FIG. 10 of the drawings is perspective view of another embodiment, showing, a produce wrap station below the label apparatus, and integrally formed with the frame thereof.

FIG. 10 is an embodiment which incorporates a product wrapping station integral with the label apparatus. In such an embodiment, a station which allows for a roll of wrap (often a cling-type clear wrap), along with sections for receiving the product and any tray or plate associated therewith, and a blade for cutting or separating the wrap from the roll is provided. In such a configuration, the user can wrap product as desired and as needed, and then reach up and pull the desired label from the label carrier. It will be understood that the entire assembly can be moved as a unit. In turn, a full label apparatus and a manual food wrapping machine is presented as a single unit.

Figure 11:
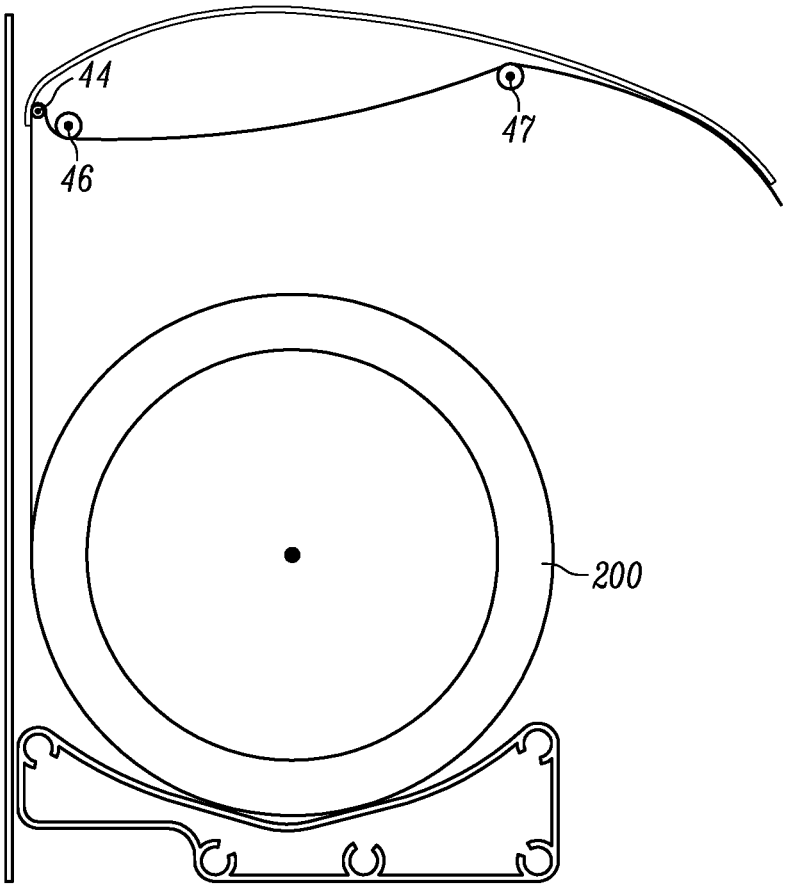
FIG. 11 of the drawings is a side elevational view of an additional configuration of the present disclosure, one that is particularly well suited for elongated or longer labels.

Another configuration is shown in FIG. 11, which is particularly useful for the dispensing of longer labels and the like. As can be seen, the peel shaft 44 and the support shaft 46 are moved aft toward the rear surface. An additional carrier shaft 47 is positioned proximate the front of the dispenser, generally parallel to the support shaft and the peel shaft, and spaced apart therefrom. In the configuration shown, the support shaft 46 and the carrier shaft 47 are positioned horizontally on the same or substantially the same plane, although variations are contemplated.

In operation, the carrier sheet extends proximate the back wall, and is threaded over the peel shaft 44 and then back down between the peel shaft 44 and the support shaft 46. As these components are placed in close proximity, the carrier goes through a rather sharp turn. The carrier is then threaded so as to go over the carrier shaft 47. Due to the small radius, as with the prior embodiments, the label is separated from the carrier at the peel shaft. In the configuration shown, the carrier/film loops close to half way around the peel shaft, making almost a 180° rotation therearound.

The carrier proceeds along the threaded path set forth above, with the label extending over the support shaft and over the carrier shaft 47. It may rejoin with the carrier shaft, or overlie the carrier shaft as is shown in the drawings. The user can then remove the remainder of the label from the carrier. Generally, the carrier is pulled until the label is virtually completely removed from the underlying carrier, at which time, it can easily be fully removed. The carrier is maintained in the orientation shown, so that when pulled again, the subsequent label can be released from the carrier. Eventually, when the carrier portions no longer having labels becomes quite long, the user can cut or trim it so that it can still be pulled without being undesirably long or tangled.

It will be understood that the construction of the different components, such as the peel shaft, the support shaft and the carrier shaft can be made according to the construction set forth above. It will be understood that all of the shafts may be fixed or may rotate, or may include rollers or the like that do rotate, to minimize the friction and other stresses on the underlying carrier. While no particular label sizes are required, but it is contemplated that the labels may be from approximately 3-4 inches long to more than 24 inches long.

It will be understood that in certain configurations, the peel shaft, that is generally of a small diameter is tensioned so as to limit and/or lessen the deflection over a distance based upon the torque setting. This can be either stationary or rotating when in operation. Such a configuration is quite useful in a wide format label dispensing application, wherein the otherwise deflected member would negate the operation of the device.

Additionally, it is contemplated that a shaped profile may be utilized that has the functions of a pivot axis and a pivot shaft in a single structure that would alter the path of the label, without altering the functional aspects of each of the components.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A label dispenser apparatus configured for dispensing labels from a plurality of rolls of a carrier film having labels disposed thereon, the label dispenser apparatus having at least one label dispensing unit comprising:

a lower roll retaining member extending from a first side to a second side, the lower roll retaining member including a front edge, a back edge and a concave surface therebetween, the concave surface being configured to cradle the plurality of rolls of the carrier film having labels disposed thereon;

an upper tape guide assembly spaced apart from the lower roll retaining member extending from the first side to the second side, in a configuration that is substantially parallel to the lower roll retaining member, thereby defining a space therebetween for positioning of the plurality of rolls of the carrier film having labels disposed thereon, the upper tape guide assembly further comprising:

a peel shaft comprising a rod that extends substantially parallel to the back edge of the lower roll retaining member, and configured to be above the plurality of rolls of carrier film having labels disposed thereon;

a support shaft extending substantially parallel to the peel shaft, and vertically closer to the lower roll retaining member; and a carrier shaft extending substantially parallel to the peel shaft and the support shaft, an unimpeded path disposed from the support shaft to the carrier shaft, and the carrier shaft positioned so as to be substantially proximate the front edge of the lower roll retaining member and configured to be above the plurality of rolls of carrier film having labels disposed thereon, the label dispensing unit lacking guide elements between the peel shaft and the carrier shaft, wherein a film guide path is defined to extend behind and around the peel shaft, then between the peel shaft and the support shaft, looping around the support shaft so as to thereafter extend the film guide path substantially in a direction of the carrier shaft and over the carrier shaft, such that a label is released by the movement around the peel shaft, and the film guide path proceeds directly between the support shaft and the carrier shaft, the carrier shaft contacting a carrier liner of the carrier film; and wherein the peel shaft is positioned proximate a back wall that extends upwardly from the rear edge of the lower roll retaining member, to, in turn, be configured to allow the carrier film to extend from the roll substantially parallel to the back wall to the peel shaft.

2. The label dispenser apparatus of claim 1 wherein the support shaft and the carrier shaft are substantially parallel to each other and generally equidistantly spaced from the lower roll retaining member.

3. The label dispenser apparatus of claim 1 wherein the peel shaft is positioned relative to the support shaft so that the carrier film is configured to extend approximately half way around the peel shaft.

4. The label dispenser apparatus of claim 1 wherein the carrier film has tangential contact on a front incline and a back incline of the concave surface of the lower roll retaining member.

5. The label dispenser apparatus of claim 1 wherein the support shaft and the carrier shaft are positioned horizontally at least substantially on a same plane.

6. The label dispenser apparatus of claim 1 further comprising a separator assembly including a pivot shaft and a plurality of separator blades that pivot about the pivot shaft, the plurality of separator blades being positioned between the plurality of the plurality of rolls of the carrier film having labels disposed thereon, respectively.

* * * * *